United States Patent [19]

Nakahama et al.

[11] Patent Number: 4,734,065

[45] Date of Patent: Mar. 29, 1988

[54] SYSTEM FOR STABLE RUNNING OF MARINE PROPULSIONS

[75] Inventors: Ryoji Nakahama; Katsuji Hirade; Takashi Koike, all of Hamamatsu, Japan

[73] Assignee: Sanshin Kogyo Kabushiki Kaisha, Japan

[21] Appl. No.: 870,458

[22] Filed: Jun. 4, 1986

[30] Foreign Application Priority Data

Jun. 5, 1985 [JP] Japan ..... 60-121700

[51] Int. Cl.[4] ..... B63H 21/26

[52] U.S. Cl. ..... 440/1; 440/61; 440/56

[58] Field of Search ..... 440/1, 55, 56, 61, 65, 440/900, 84, 88; 114/275, 276, 279, 280; 180/277, 279

[56] References Cited

U.S. PATENT DOCUMENTS 1,850,744 3/1932 Trapani ..... 180/277
2,975,750 3/1961 Smith ..... 440/56
4,432,734 2/1984 Bland et al. ..... 440/1
4,490,120 12/1984 Hundertmark ..... 440/61
4,554,892 11/1985 Amenori et al. ..... 440/900

*Primary Examiner*—Joseph F. Peters, Jr.
*Assistant Examiner*—Edwin L. Swinehart
*Attorney, Agent, or Firm*—Ernest A. Beutler

[57] ABSTRACT

A number of embodiments of arrangements for stabilizing the running of a marine propulsion unit by slowing the speed of the propulsion unit when an underwater obstacle is struck. In some embodiments, the slowing is accomplished by misfiring of the engine and in other embodiments, the speed is reduced by throttling the fuel supply to the engine. The embodiments illustrate the application of the principle to an outboard drive of an inboard/outboard drive arrangement or for an outboard motor. The striking of the underwater obstacle is sensed by either an impact sensor, by sensing the angular position of the outboard drive, or by sensing the rise in pressure in a shock absorber that resists the popping up action.

16 Claims, 11 Drawing Figures

SYSTEM FOR STABLE RUNNING OF MARINE PROPULSIONS

BACKGROUND OF THE INVENTION

This invention relates to a system for the stable running of a marine propulsion unit and more particularly to an improved arrangement for preventing unwanted watercraft action upon the popping up of an outboard drive due to its striking an underwater obstacle or under similar circumstances.

As is well known, most outboard drive units, either outboard motors or the outboard drive portion of an inboard/outboard drive, are supported for pivotal movement about a horizontally extending tilt axis. This tilting movement is provided for a variety of reasons such as to adjust the trim angle, to permit the outboard drive to be tilted up when not in use and also so as to permit popping up of the outboard drive when an underwater obstacle is struck. This latter purpose is intended to prevent damage to the outboard drive under this type of condition.

Although permitting popping up of the outboard drive when an underwater obstacle is struck protects the outboard drive; when the outboard drive returns to its normal running position, there can be certain unsatisfactory conditions arise in the resulting watercraft. For example, the rapid change of trim can produce a surging in the condition in the watercraft that can upset the passengers, it can cause a rolling operation of the watercraft or it could result in an abrupt and unexpected turn in the watercraft direction. Although these conditions are less objectionable than those which would result if popping up were not permitted, it would be desirable if they could also be avoided.

It is, therefore, a principal object of this invention to provide an arrangement for providing stable running when the outboard drive has popped up and returned to its normal running condition.

It is a further object of this invention to provide an arrangement for achieving stability under popping up operation by slowing the speed of the propulsion unit for a time period after the outboard drive returns to its normal position.

SUMMARY OF THE INVENTION

This invention is adapted to be embodied in a marine propulsion unit for a watercraft having an outboard drive with a propulsion unit. Means are provided for supporting the outboard drive for tilting movement about a generally horizontally extending tilt axis. Sensing means are incorporated for sensing an abnormal movement of the outboard drive about the tilt axis and means are provided for slowing the propulsion means in response to the sensed abnormal tilt up condition.

DETAILED DESCRIPTION OF THE PREFERRED EMBODIMENTS

Figure 1:
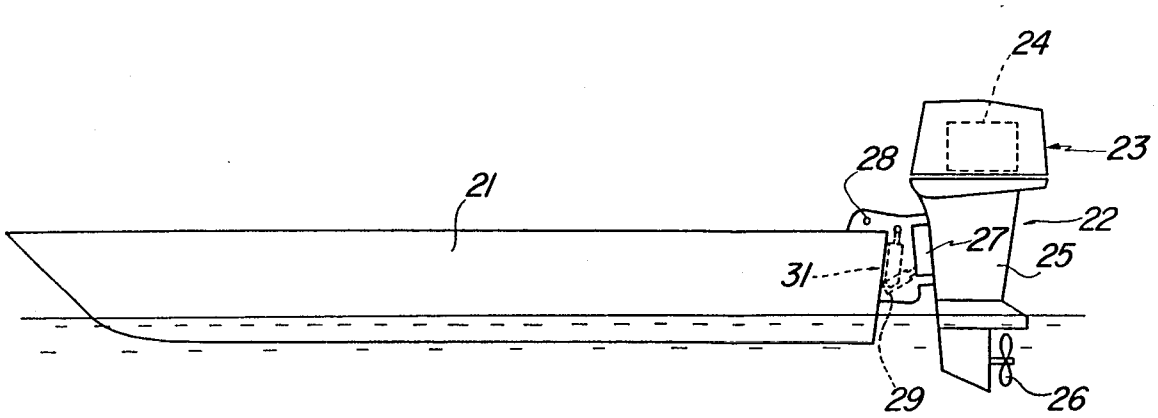
FIG. 1 is a side elevational view of a watercraft constructed in accordance with an embodiment of the invention.

FIG. 1 illustrates how the invention may be applied to a watercraft 21 that is powered by an outboard motor indicated generally by the reference numeral 22. The outboard motor 22 includes a power head 23 which includes an internal combustion engine having a spark ignition system 24. The engine 24 drives a drive shaft that extends through a drive shaft housing 25 and which drives a propeller 26 of a lower unit.

Figure 7:
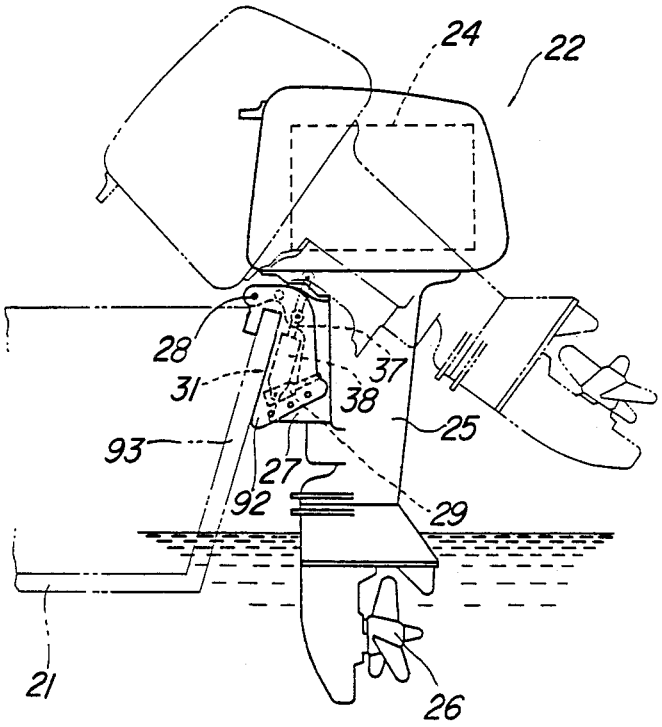
FIG. 7 is an enlarged side elevational view of an outboard motor and associated watercraft constructed in accordance the embodiment of FIG. 1 and showing another embodiment of the invention.

The outboard motor has a swivel bracket 27 that journals a steering shaft (not shown) that is affixed to the drive shaft housing 25 for steering of the outboard motor 22 about a generally vertically extending axis. The swivel bracket 27 is, in turn, connected to a clamping bracket (as seen in FIG. 7) by means of a horizontally extending pivot pin 28 for tilting movement of the outboard drive about a horizontally extending axis. This tilting movement is controlled by a trim cylinder 29 and a tilt cylinder 31. The tilt cylinder 31 in addition to providing for power tilting of the outboard motor 22 includes a shock absorber arrangement that will accommodate popping up of the outboard motor when an underwater obstacle is struck. In accordance with the invention, a means is provided for slowing the speed of the outboard motor 22 when this condition occurs and FIG. 2 illustrates schematically how this system works.

Figure 2:
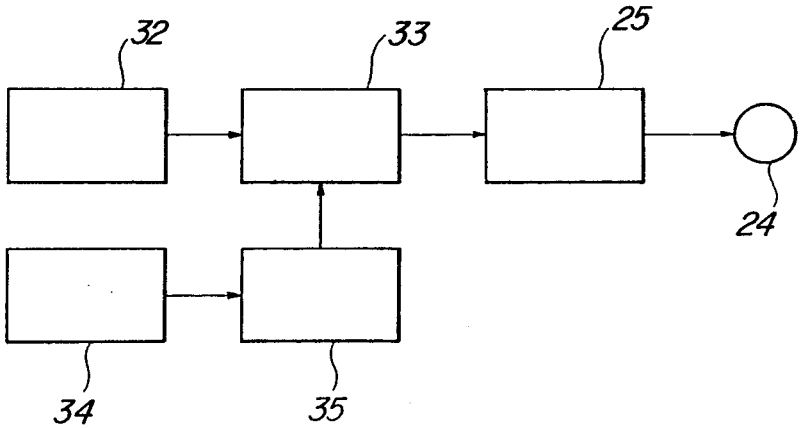
FIG. 2 is a schematic block diagram showing the arrangement for controlling the watercraft of the embodiment of FIG. 1.

Referring to the block diagram of FIG. 2, the engine and its spark ignition system 24 includes an ignition circuit 25 that fires the spark plugs of the engine 24 in a known manner. A sensor, indicated schematically at 32, is provided for sensing an abnormal popping up condition. The sensor 32 may sense this function by any of a variety of manners, as will become apparent as this description proceeds. The sensor 32 sends an output signal to a circuit, indicated generally at 33, which sends a misfiring signal to the ignition circuit 25 so as to interrupt the regular ignition of the engine 24 so as to reduce the speed of the engine 24 under an abnormal condition.

The system also includes a throttle position sensor, indicated schematically at 34, which senses the position of the throttle valve of the engine 24 and sends a signal to a comparator circuit 35. The comparator circuit 35 determines if the opening of the throttle, as determined by the sensor 34, is sufficient that misfiring should be initiated in the event of a popping up condition is sensed by the sensor 32. It is desired that misfiring of the engine does not occur at low engine speeds (low throttle opening) so as to reduce the likelihood of stalling of the engine 24.

Figure 3:
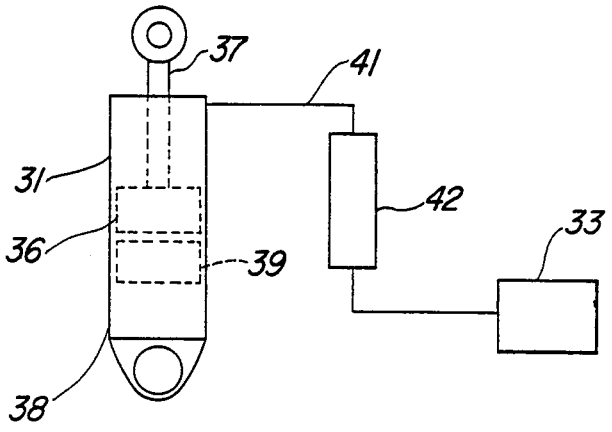
FIG. 3 is a partially schematic view, showing one type of arrangement for sensing an abnormal tilt condition.

Referring now to FIG. 3, there is depicted a type of sensor which may be employed with the unit as shown in FIG. 1 for controlling or providing an output sign that will slow the propulsion unit when the outboard motor pops up. In this figure, the tilt cylinder 31 is depicted as having a piston 36 which is connected by means of a piston rod 37 to the outboard motor 22, for example, the swivel bracket 27. The piston 36 is valved to act as a shock absorber and is slidably supported within a cylinder assembly 38 which has a pivotal connection to the clamping bracket so that the piston 36 will reciprocate in the bore of the cylinder 38 upon pivotal movement of the outboard motor 22 about the pivot pin 28. In addition, a floating piston 39 may be positioned within and below the piston 36 for adjusting the trim position. The fluid motor or device 31 is adapted to be hydraulically powered for power tilting and trim in addition to acting as a shock absorber and is of the type well known in this art and, for that reason, it is believed unnecessary to illustrate the device in any more detail.

The upper chamber of the cylinder is connected by means of a conduit 41 to a pressure sensor 42, which may be of any known type, such as a piezoelectric device. The sensor 42 will sense an abnormally high pressure in the chamber above the piston 36 upon popping up movement and will transmit this signal to the control circuit 33 for initiating misfiring of the engine so as to reduce its engine speed if the other parameters indicating such a need are present.

Figure 4:
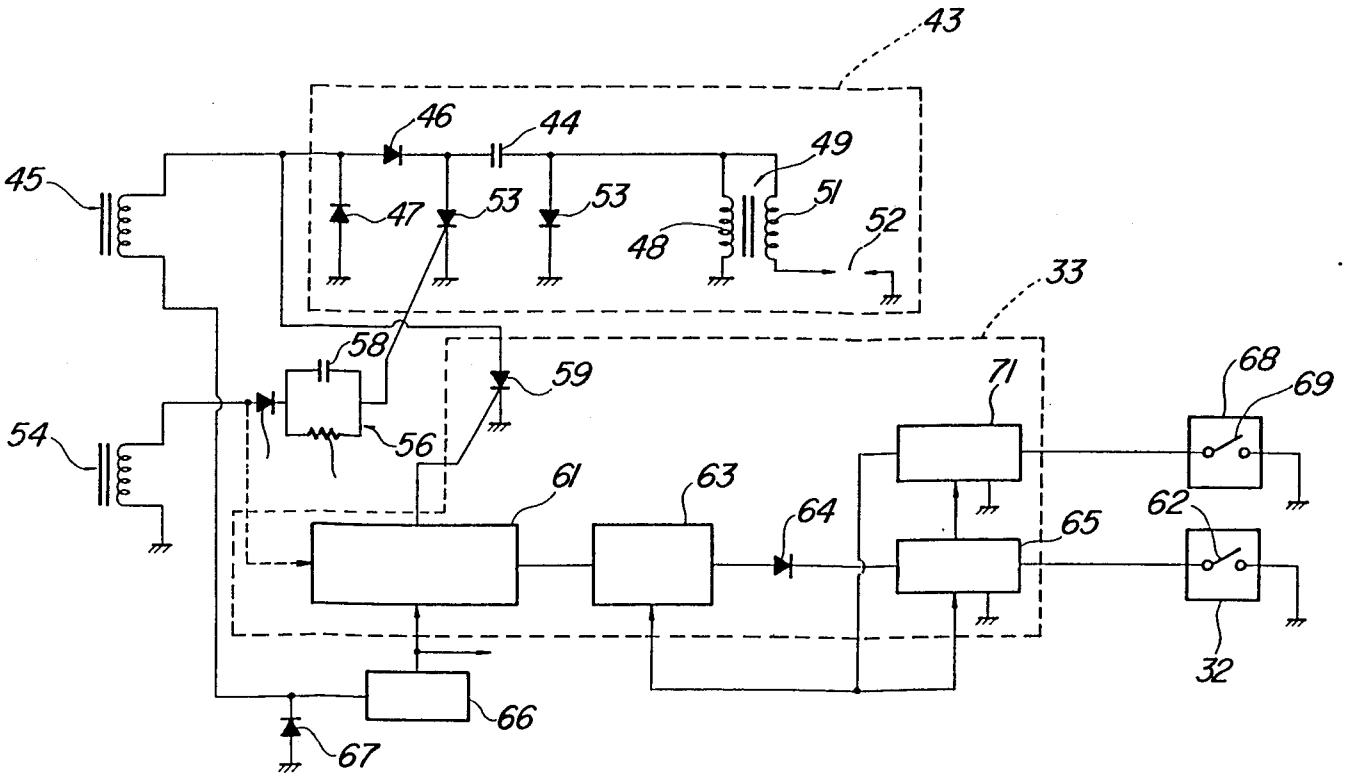
FIG. 4 is a schematic view showing one arrangement for controlling the speed of the watercraft under an abnormal tilting up condition.

FIG. 4 is a circuit diagram showing one manner in which the engine speed may be controlled by achieving misfiring although it is to be understood that other circuits are possible for this purpose. In this figure, the conventional ignition circuit is identified generally by the block 43 that includes a firing capacitor 44 that is charged by a charging coil 45 which is energized by the flywheel magneto of the engine in a known manner. A diode 46 is interposed between the charging coil 45 and the firing capacitor 44. In addition, a diode 47 is positioned between the charging coil 45 and the firing capacitor 44 and the ground.

The firing capacitor 44 is in circuit with a primary winding 48 of an ignition coil, indicated generally by the reference numeral 49. The ignition coil 49 further includes a secondary winding 51 which is in circuit with a spark plug 52.

A further diode 53 is positioned between the firing capacitor 44 and the ground in parallel circuit with the primary winding 48.

As the flywheel of the engine rotates, the charging coil 45 will build up a charge on the firing capacitor 44. When the capacitor 44 is charged, it may be discharged through the ground by means of an SCR 53 so as to cause a voltage to be induced in the primary coil 48 and induce a stepped up voltage in the secondary coil 51 for firing the spark plug 52 in a well known manner. In order to trigger or render the SCR 53 conductive, there is provided a pulser coil 54 which is also associated with the engine flywheel and which receives a pulse when a permanent magnet carried by the flywheel passes the pulser coil 54. The pulser coil 54 is in circuit through a diode 55 with a triggering circuit 56 comprises of a parallel resistor 57 and capacitor 58 for rendering the gate of the SCR conductive at an appropriate time to effect firing of the spark plug 52 in the manner previously described.

The misfiring control circuit 33 includes a device for rendering an SCR 59 in parallel circuit with the SCR 53 and ground conductive at a time prior to the normal firing time for the spark plug 52 so as to effect misfiring and prevent ignition within the combustion chamber so as to reduce speed. The circuit 33 comprised of a gate circuit 61 for the gate of the SCR 59 for rendering it conductive to cause misfiring in response to the conditions, as aforedescribed. Misfiring gate circuit 61 is controlled by means of the sensor 32, which may be a pressure sensor of the type shown in FIG. 3, for closing a switch 62 in response to the sensing of a tilt or pop up operation. When the switch contact 62 is closed, the gate circuit 61 will be energized by grounding it through a timer circuit 63, diode 64 and circuit 65. When the circuit 65 is energized, it will send a signal back to the timer circuit 63 to begin its running and to hold the gate circuit 61 in an energized condition so that when the pulser coil 54 sends a signal, it is transmitted through the circuit 61 with a time delay to gate the SCR 59 and effect misfiring of the spark plug 52. A power circuit 66 supplies power to the overall system and there is a rectifying diode 67 in this power circuit. The timer circuit 63 causes misfiring for a preset period of time so as to slow the engine for such a preset period of time when the motor has popped up as sensed by the sensor 32.

There is, however, embodied in the circuit a throttle position detector switch 68 having a contact 69 which is closed when the throttle valve is closed below a predetermined amount. This indicates that misfiring is not necessary at this slow speed and, in fact, undesirable because stalling of the engine may occur. When the throttle position sensor switch contact 69 is closed, a reset circuit 71 for the circuit 65 is energized which cancels the signal from the circuit 65 that energizes the holding circuit 63 so that there will be no holding on of the SCR 59 and misfiring will not occur.

Figure 5:
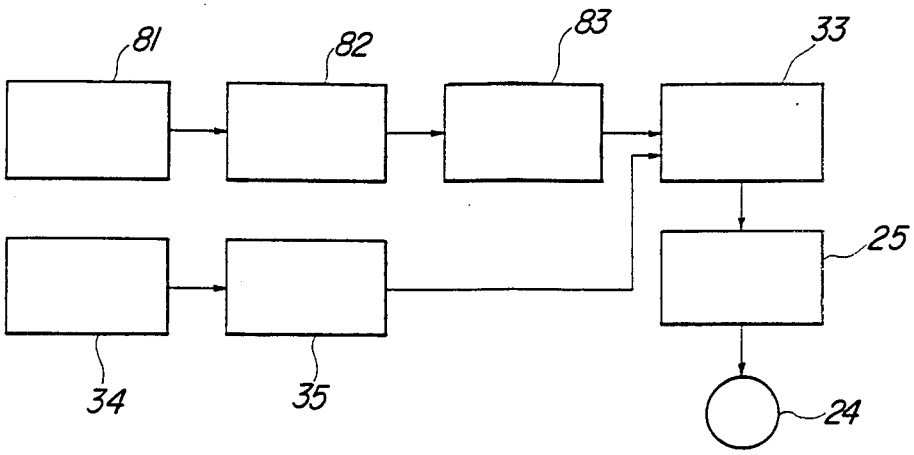
FIG. 5 is a schematic block diagram showing another arrangement for sensing an abnormal condition and accommodating for it.

FIG. 5 shows another embodiment of the invention wherein the misfiring circuit 33 is energized to cause misfiring of the ignition circuit 25 in response to a sensed change in trim angle. For this purpose, there is provided a trim angle sensor 81, which may be of a type as will hereinafter be described, that outputs a signal indicative of the trim angle position of the outboard drive to a differentiating circuit 82. The differentiating circuit 82 outputs its signal, which is indicative of a rate of change of the trim angle, to a comparator circuit 83 which compares this rate of change with a preset value that indicates when a popping up condition which requires a reduction in speed of the engine has occurred. When this condition is sensed, the misfiring circuit 33 is energized as previously described to effect misfiring of the ignition circuit 25 and slowing of the speed of the engine 24. Again, a throttle position sensor 34 is provided in circuit with a comparator circuit 35 so as to prevent or block the misfiring signal if the throttle valve is not opened more than a predetermined degree.

Figure 6:
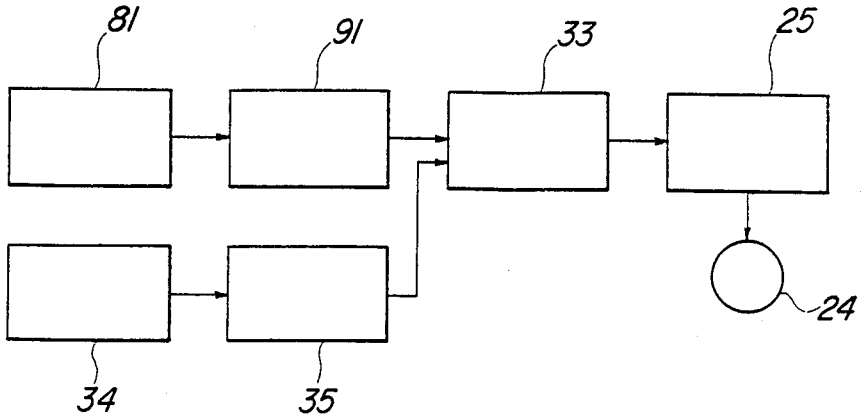
FIG. 6 is a block diagram, in part similar to FIG. 5, showing yet another embodiment of the invention.

FIG. 6 shows another embodiment of the invention. This embodiment operates on the logic that the trim position of the outboard motor is normally adjusted through a predetermined normal range and movement of the trim position of the outboard motor beyond this range indicates a popping up condition which is determined to require slowing of the outboard motor. With this embodiment, the trim angle sensor 81 outputs its signal to a comparator circuit 91 that compares the actual trim angle with a maximum normal trim angle and if this angle is exceeded, it is determined that a popping up condition has occurred and the misfiring circuit 33 is energized to effect misfiring of the ignition circuit 25 assuming that the throttle position sensor 34 indicates that the predetermined throttle position has been exceeded and the speed of the outboard is such that such misfiring is desirable.

Figure 8:
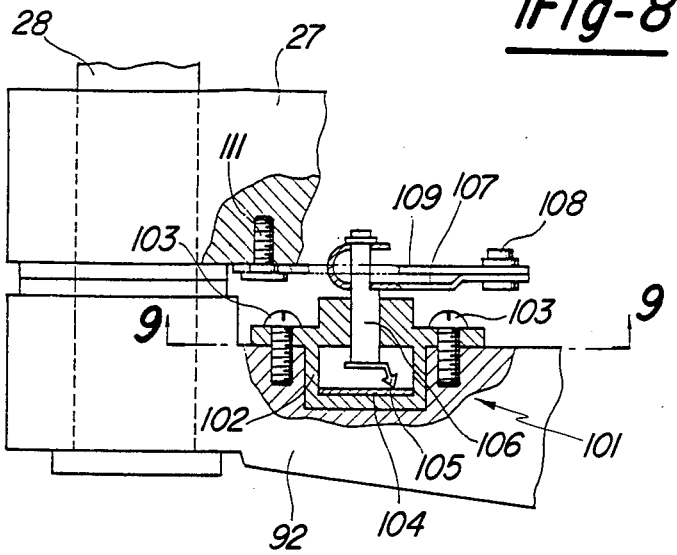
FIG. 8 is an enlarged top plan view showing another form of sensor, which may be utilized with the embodiment of FIG. 7, with a portion broken away.
Figure 9:
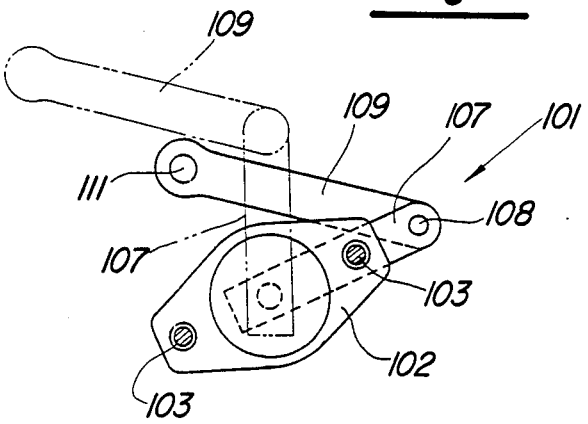
FIG. 9 is a side elevational view of the sensor shown in FIG. 8.

FIG. 7 is a further enlarged view of the outboard motor 22 and associated watercraft 21 as shown in FIG. 1 and FIGS. 8 and 9 show an embodiment of a trim position sensor that may be utilized in conjunction with the circuits shown schematically in FIGS. 5 and 6. In FIG. 7, the clamping bracket is identified by the reference numeral 92 and affords the means for attachment to the transom 93 of the watercraft 21.

Referring now specifically in detail to FIGS. 8 and 9, the trim position sensor is identified generally by the reference numeral 101 and includes a potentiometer housing 102 that is affixed in a suitable manner, as by means of screws 103 to the clamping bracket 92. The housing 102 carries a resistor plate 104 that is contacted by a wiper switch 105 which is, in turn, afixed to a shaft 106. The shaft 106 is journalled in the housing 102 and is staked to one end of a first lever 107. The other end of the lever 107 is connected by means of a pivot pin 108 to a second lever 109. The opposite end of the lever 109 is pivotally connected to the swivel bracket 27 by means of a pivot pin 111. Hence, pivotal movement of the swivel bracket 27 relative to the clamping bracket 93 effects movement of the shaft 106 and wiper 105 to vary the resistance of the potentiometer 102 in response to the changes in angular position of the outboard motor as shown by the solid and broken line views of FIG. 9.

Figure 10:
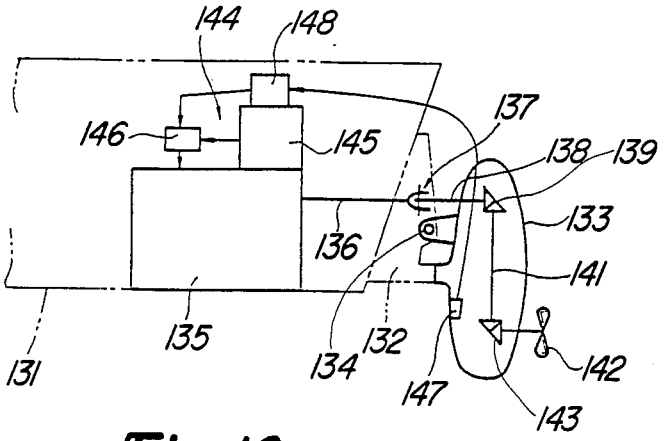
FIG. 10 is a partially schematic side elevational view of an inboard/outboard drive constructed in accordance with yet another embodiment of the invention.

In the embodiments of the invention as thus far illustrated and described, the invention has been shown in conjunction with an outboard motor. However, it is to be understood that the invention may be equally as well applied to an inboard/outboard drive and such an embodiment is shown in FIG. 10. In this figure, a hull of a watercraft is identified generally by the reference numeral 131 and this includes a stern plate 132 on which an outboard drive unit 133 is supported for pivotal movement about a horizontally extending pivot pin 134.

An inboard mounted internal combustion engine 135 drives an output shaft 136 which is coupled by means of an universal joint 137 to an input shaft 138 of the outboard drive 133. The input shaft 138 drives a bevel gear train 139 which, in turn, drives a drive shaft 141 that is rotatably journaled in the outboard drive 133. The drive shaft 141 drives a propeller 142 through a bevel gear train 143.

In the embodiments as thus far described, the speed of the engine has been reduced by misfiring of the spark plug. It is to be understood that the speed may be reduced in other manners, as by reducing the supply of fuel to the engine and FIG. 10 illustrates such an embodiment. In FIG. 10, the engine 135 is of the diesel type and includes a fuel injection system, indicated generally by the reference numeral 144 that includes a fuel injection pump 145 which is driven by the engine and which delivers fuel to the injection nozzles through an electronically controlled valve 146.

In this embodiment, popping up of the outboard drive 133 is sensed by means of an impact sensor 147 that is mounted at the front lower end of the outboard drive 133 and which will sense the impact when an underwater obstacle is struck sufficiently hard so as to cause popping up of the outboard drive 133. When this occurs, a signal is sent to a control circuit 148 which, in turn, controls the electronic valve 146 to reduce the amount of fuel supplied to the engine 135 for a period of time so as to effect slowing of the engine.

Figure 11:
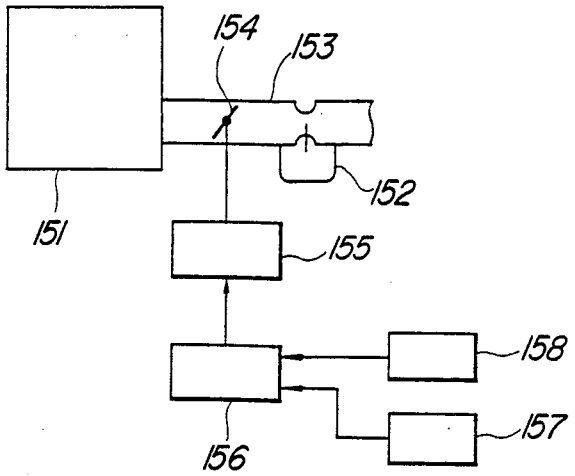
FIG. 11 is a partially schematic view of another embodiment for achieving engine speed control under abnormal conditions.

FIG. 11 shows another embodiment of the invention wherein the slowing is accomplished by reducing the fuel supply by throttling the intake air and is depicted in conjunction with an internal combustion engine 151 having a carburetor 152 with an induction passage 153 in which a throttle valve 154 is positioned. The throttle valve 154 has its position controlled by an electric motor 155 which, in turn, is operated by a controller 156. The controller 156 is controlled by a manual throttle valve operator 157 which the watercraft driver may manipulate so as to select the position of the throttle valve 154 and the speed of the engine. There is, however, provided an automatic overriding circuit 158 which is energized by a popping up or hitting sensor as in any of the previously described embodiments for controlling the circuit 156 and motor 155 to reduce the opening of the throttle valve 154 for a predetermined time period so as to effect slowing of the motor under such a condition.

It should be readily apparent from the foregoing description that a number of embodiments of the invention have been illustrated and described, each of which is effective to prevent an unstable watercraft condition which might otherwise occur if an underwater obstacle is struck and the outboard drive, be it an outboard motor or the outboard drive portion of an inboard/outboard drive, pops up and returns without a reduction in speed. Although a number of embodiments have been illustrated and described, various changes and modifications may be made without departing from the spirit and scope of the invention, as defined by the appended claims.

We claim:

1. In a marine propulsion unit for a watercraft having an outboard drive having a propulsion unit driven by an engine, means for supporting said outboard drive for tilting movement about a generally horizontally extending tilt axis, means for sensing an abnormal movement of said outboard drive about said tilt axis, and means for slowing said propulsion unit for only a predetermined time period without stopping said engine in response to a sensed abnormal movement.

2. In a marine propulsion unit as set forth in claim 1 wherein the abnormal movement is caused by impact with an underwater object.

3. In a marine propulsion unit as set forth in claim 2 wherein the impact is sensed by a contact sensor.

4. In a marine propulsion unit as set forth in claim 3 wherein the contact sensor is carried by the lower front portion of an outer housing of the propulsion unit.

5. In a marine propulsion unit as set forth in claim 2 wherein the impact is sensed by measuring the angle of the outboard drive about its tilt axis.

6. In a marine propulsion unit as set forth in claim 1 wherein the abnormal movement is sensed by measuring the angle of tilt.

7. In a marine propulsion unit as set forth in claim 6 wherein the abnormal movement is sensed when the angle of tilt exceeds a predetermined angle.

8. In a marine propulsion unit as set forth in claim 6 wherein the abnormal movement is sensed by sensing the rate of change of the angle of tilt.

9. In a marine propulsion unit as set forth in claim 1 wherein after the predetermined time period the propulsion unit returns to the speed existent immediately before the abnormal movement occurred.

10. In a marine propulsion unit as set forth in claim 1 wherein the propulsion unit comprises a propeller and the means for slowing the propulsion unit slows the speed of rotation of the propeller.

11. In a marine propulsion unit as set forth in claim 10 wherein the propeller is slowed by throttling the driving engine.

12. In a marine propulsion unit as set forth in claim 10 wherein the engine is spark ignited by an ignition circuit and the propeller is slowed by misfiring the ignition circuit of the engine.

13. In a marine propulsion unit as set forth in claim 10 wherein the speed of rotation of the propeller is slowed by reducing a supply of fuel to the engine.

14. In a marine propulsion unit as set forth in claim 13 wherein the fuel is supplied by a fuel injection unit.

15. In a marine propulsion unit as set forth in claim 1 wherein the propulsion unit is the outboard drive of an inboard/outboard drive system.

16. In a marine propulsion unit for a watercraft comprising an outboard drive having a propulsion unit driven by an engine, means for supporting said outboard drive for tilting movement about a generally horizontally extending tilt axis, a tilt cylinder interposed between said outboard drive and the watercraft, means for sensing an abnormal movement of said outboard drive about said tilt axis as is caused by impact with an underwater object, and means for slowing said propulsion unit without stopping said engine in response to a sensed abnormal movement, said impact being sensed by sensing an increase in pressure in said tilt cylinder.

* * * * *